US006193277B1

(12) United States Patent
Marasco et al.

(10) Patent No.: US 6,193,277 B1
(45) Date of Patent: Feb. 27, 2001

(54) WALKING SOLE FOR IN-LINE SKATE

(76) Inventors: Vincent Marasco; Edward Mazzarino, both of 4339 Allott Ave., Sherman Oaks, CA (US) 91423

( * ) Notice: Subject to any disclaimer, the term of this patent is extended or adjusted under 35 U.S.C. 154(b) by 0 days.

(21) Appl. No.: 09/378,453

(22) Filed: Aug. 20, 1999

Related U.S. Application Data

(63) Continuation-in-part of application No. 29/081,268, filed on Dec. 29, 1997.

(51) Int. Cl.[7] ..... A63C 3/99
(52) U.S. Cl. ..... 280/825; 280/809; 280/811
(58) Field of Search ..... 280/825, 11.221, 280/811, 809, 7.12, 7.13; D21/772

(56) References Cited

U.S. PATENT DOCUMENTS

| | | | | |
|---|---|---|---|---|
| D. 112,078 | * | 11/1938 | Lewis | D21/772 |
| 1,725,821 | | 8/1929 | Nathan | 280/825 |
| 4,264,090 | | 4/1981 | Davies | 280/825 |
| 5,236,224 | | 8/1993 | Anderson et al. | 280/825 |
| 5,290,065 | * | 3/1994 | Kassal | 280/825 |
| 5,522,621 | * | 6/1996 | Schneider | 280/825 |
| 5,573,275 | * | 11/1996 | Smith et al. | 280/825 |
| 5,697,643 | | 12/1997 | Marasco et al. | 280/825 |
| 5,765,870 | * | 6/1998 | Riley | 280/825 |
| 5,848,808 | * | 12/1998 | Fenton | 280/825 |
| 5,951,049 | * | 9/1999 | Calverley et al. | 280/825 |
| 5,988,682 | * | 11/1999 | Allera | 280/825 |
| 6,079,747 | * | 6/2000 | Winsor | 280/825 |

* cited by examiner

*Primary Examiner*—J. J. Swann
*Assistant Examiner*—James S. McClellan
(74) *Attorney, Agent, or Firm*—Donald Diamond

(57) ABSTRACT

A walking sole which enables a person wearing in-line skates to walk freely. The walking sole includes a U-shaped member having a longitudinal trough into which a skate's wheels are inserted, and two slidably adjustable alignment posts which are brought into pressing contact with the outer wheels. Each post is securely fixed to the base of the U-shaped member by interfacing corrugations in its bottom surface with corrugations in the base upper surface before connecting the post and base with a bolt.

9 Claims, 3 Drawing Sheets

WALKING SOLE FOR IN-LINE SKATE

CROSS-REFERENCE TO RELATED APPLICATION

This application is a continuation-in-part of U.S. design application Ser. No. 29/081,268, filed Dec. 29, 1997 and entitled "Portable Walking Sole for In-Line Skate," now abandoned.

BACKGROUND OF THE INVENTION

1. Field of the Invention

The invention relates to accessories for in-line roller skates and, more particularly, to a walking sole into which the wheels of a skate can be easily inserted, securely maintained while inserted, and then easily removed. The walking sole includes a planar bottom surface so that a user wearing a sole on each skate can walk freely, even on stairs, ramps, rough surfaces and hills.

2. Description of the Related Art

In recent times, the roller skating public increasingly has come to prefer in-line-type skates over skates having tandem wheels. In-line skates are available under various brand names as, for example, ROLLERBLADE which is a trademark of Rollerblade, Inc. of Minnetonka, Minn. and are characterized by a shoe attached to a skate assembly having three or more linearly-aligned wheels centrally located beneath the shoe. The skate assembly typically includes a rigid undercarriage riveted or otherwise rigidly fastened to the bottom of the shoe. The wheels usually are adjustably secured to the undercarriage.

In-line roller skates are extremely unstable when a person attempts to walk on an uneven or irregular surface. For example, going up or down stairs may be dangerous if not infeasible, unless a handrail can be continuously gripped, since the skates may uncontrollably roll on and over the stair treads. Uncontrolled rolling may also occur when skates are worn while attempting to traverse a slippery or sand-covered surface. More than 100,000 serious accidents occur annually involving in-line skates. Many of the accidents happen to novices who encounter situations where they lose control of balance and suffer injury from the resulting fall. Because of the danger posed by skaters to themselves and bystanders and the consequent risk of lawsuits, commercial establishments and public facilities such as restaurants, convenience stores and post offices bar individuals wearing in-line skates from entering their premises. Even if no accident occurs, in-line skates can mar and permanently damage floor surfaces such as linoleum, due to the high pressure exerted by the small contact area of the wheels.

Our U.S. Pat. No. 5,697,643 ("'643") discloses an in-line skate with an attached walker that is pivotable downward to interpose a flat walking surface between the skate wheels and ground, and pivotable upward away from the wheels and skate undercarriage so as not to interfere with skating. The walker includes a flange bolted to the undercarriage connected by a hinge to an angle member to which is attached a walking sole.

U.S. Pat. No. 5,573,275 ("'275") to B. C. Smith et al. discloses a guard device configured to closely fit over the wheels of an in-line skate. The device includes a wheel-receiving trough above a base member whose underside has a ground-contacting bottom surface, and whose top surface has concavities shaped to closely receive the wheels. The base member is bounded by forward and rearward blocking portions which prevent rolling motion fore and aft. The skate is secured to the device by loops around the rear and toe portions of the skate boot.

U.S. Pat. No. 5,236,224 ("'224") to J. D. Anderson et al. discloses a removable wheel cover for an in-line skate. The cover includes a front boot adapted to receive the skate's front wheel, and a rear boot adapted to receive the skate's rear wheel. The two boots are connected by a pair of flexible, resilient straps.

U.S. Pat. No. 4,264,090 ("'090") to J. R. Davies discloses a scabbard which can fit over the blade of an ice skate when the blade's toe and heel are rounded. The scabbard includes a blade-receiving slot and gripping members along the slot to frictionally grip a blade inserted into the slot.

U.S. Pat. No. 1,725,821 ("'821") to E. B. Nathan discloses a scabbard for an ice skate blade including two sliding fastening members each having an engagement portion formed of a resilient material such as sheet metal, and a holding means such as straps.

For users who prefer the comfort and stability of a solid, rigid walking surface, neither the '643 walker nor the '275 guard offers an ideal choice. The flanges of the '643 walker add weight which may contribute to fatigue, and some users may find the assembly cumbersome. The '275 guard is bulky and must be customized to a particular skate model. The '224 wheel cover provides only a thin, resilient surface between the wheels and ground. The '090 and '821 scabbards are adapted to ice skates rather than in-line skates. In view of the deficiencies of the existing art, what is needed is a walking sole which can provide solidity and rigidity, and which can be used with a wide variety of in-line skate brands and models.

OBJECTS OF THE INVENTION

Accordingly, it is an object of the present invention to provide a walking sole which can be removably attached to almost any in-line skate.

Another object of the invention is to provide a rigid sole that is simple, reliable and easy to use.

Yet another object of the invention is to provide a sole that is simple and inexpensive to manufacture.

Other objects of the invention will become evident when the following description is considered with the accompanying drawings.

SUMMARY OF THE INVENTION

These and other objects of the invention are achieved by providing a walking sole which in a first aspect includes a U-shaped angle member having a pair of opposed side walls attached and orthogonal to a base, thus determining a longitudinal trough for closely receiving the lower portion of each skate wheel. The base includes a planar top surface, and a planar bottom surface with a tread pattern. The walking sole further includes means for rigidly constraining fore and aft motion of the wheels when the wheel lower portions are inserted into the trough. The constraining means includes two alignment posts each having a bottom surface in slidable contact with the base top surface, and locking means for rigidly fixing each post at a position where it is in pressing contact against the rim of an outer wheel. The locking means for each post includes transverse corrugations in the post bottom surface which interface with transverse corrugations in the base top surface.

In a second aspect the invention provides a walking sole including a U-shaped angle member having a pair of opposed side walls attached and orthogonal to a base, thus determining a longitudinal trough for closely receiving the lower portion of each skate wheel. Each side wall has opposed arcuate ends and a horizontal slot disposed symmetrically between the two ends so that the slots are opposed. The base includes a planar top surface and a planar bottom surface with a tread pattern. The base further includes two outer portions symmetric with respect to a central portion. Each outer portion has a longitudinal slot bounded by transverse corrugations in the base top surface and circumscribed by a recess in the base bottom surface which terminates in an interior lip. The walking sole further includes two alignment posts each having an arcuate vertical portion, shaped to receive a wheel rim, attached and orthogonal to a horizontal portion having a bottom surface with transverse corrugations which interface with corrugations in the base top surface. Each horizontal portion has a bushing with a threaded bore. A bolt screwed into each bushing and tightened until its head tightens against the recessed lip secures the alignment post to the base. The walking sole further includes a strap inserted through the side wall slots whose ends are secured over the boot toe portion using mating hook-tape and loop-tape surfaces.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
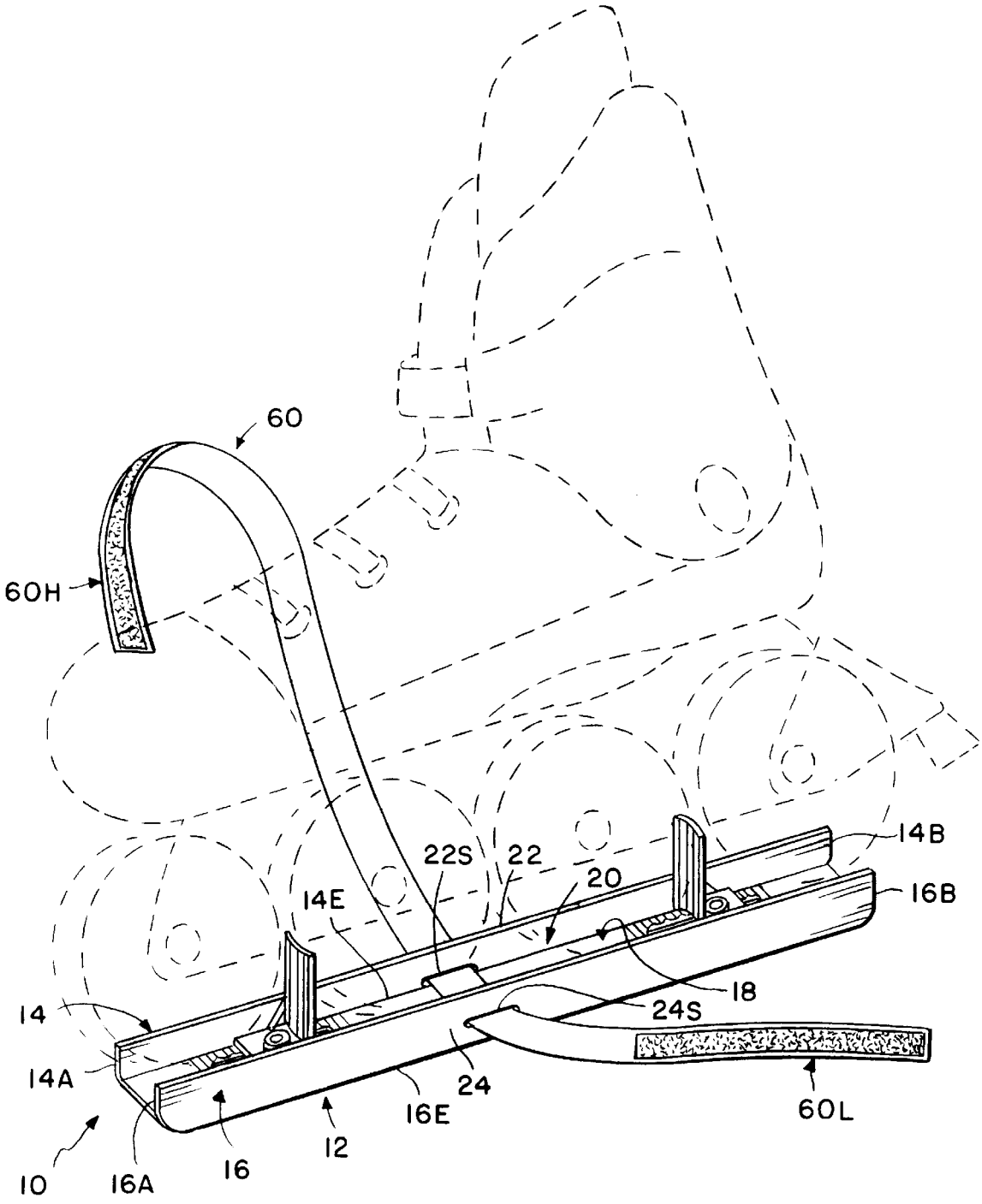
FIG. 1 is a perspective view of a walking sole for an in-line skate including a U-shaped angle member having opposed side walls attached to a base, and two slidably adjustable alignment posts.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "wear", "wearing" or "worn" means that the skate wheels are partially inserted into and constrained by the walking sole. Where used here, the word "attached" means that the two parts referred to (e.g., the base and a side wall of a U-shaped longitudinal member) are monolithically molded as a unitary structure by injection molding of a thermoplastic, as this form of attachment is preferred. However, other forms of attachment, such as riveting and adhesive joining, may be suitable, consistent with minimizing weight and expense. Where used here, the word "connected" means that the two parts referred to (e.g., the base and an alignment post) are bolted together.

Figure 2:
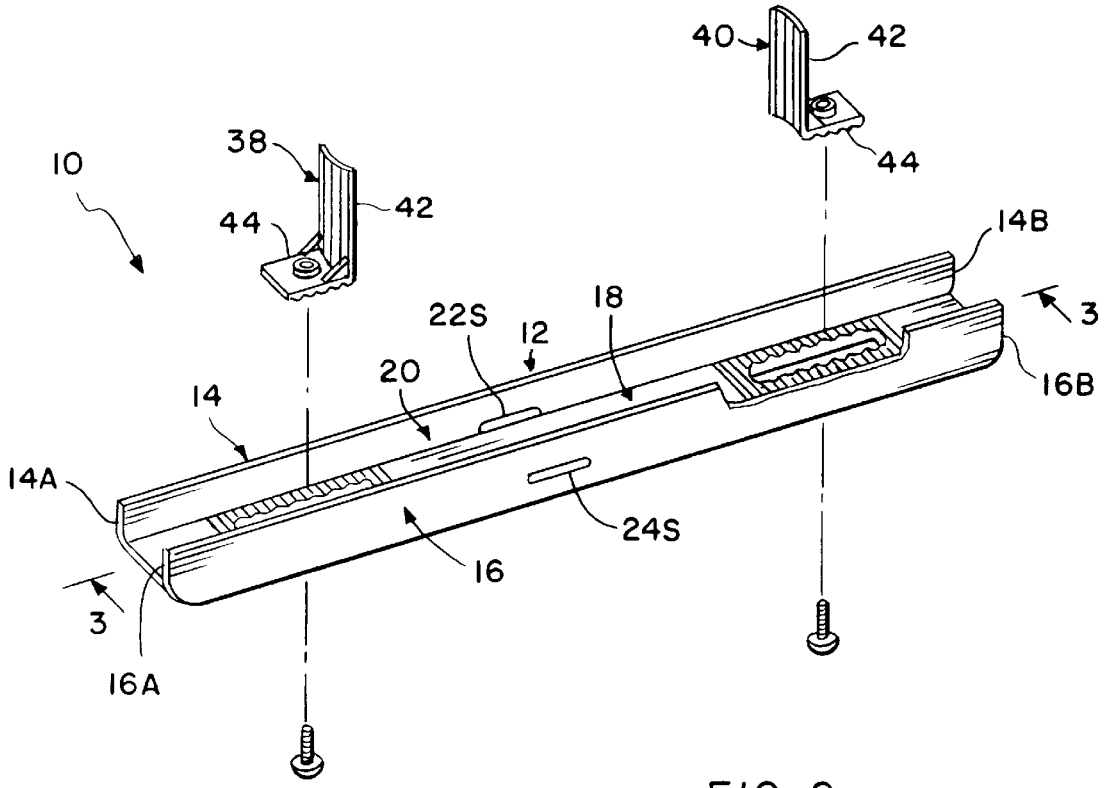
FIG. 2 is an exploded perspective view of the FIG. 1 sole.

Referring to FIGS. 1 and 2, a walking sole 10 includes a U-shaped member 12 having opposed first and second side walls 14, 16 attached along a lower edge 14E, 16E, respectively, and generally orthogonal to a base 18, thus determining a longitudinal trough 20. Side walls 14, 16 have opposed arcuate ends 14A, 14B and 16A, 16B, respectively, and a central portion 22, 24, respectively, having a generally horizontal slot 22S, 24S, respectively, disposed symmetrically between ends 14A, 14B and 16A, 16B, respectively, so that the slots are directly opposed.

Figure 3:
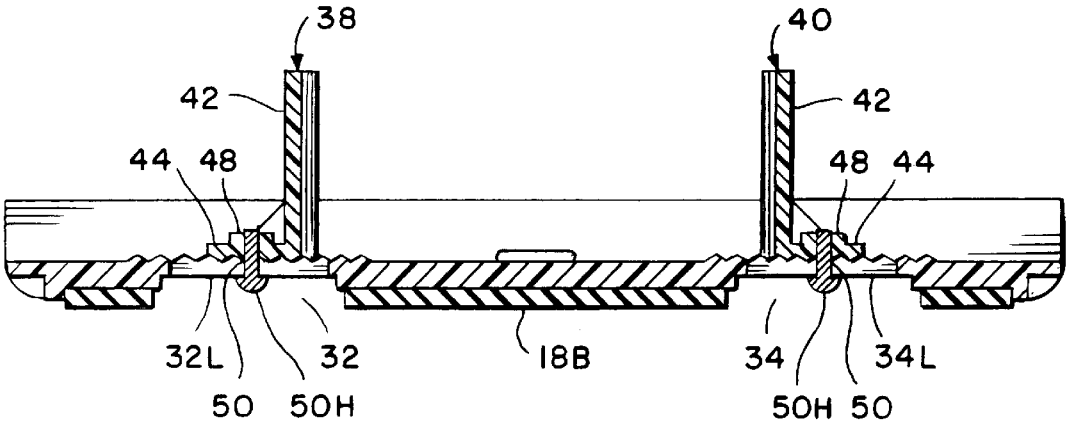
FIG. 3 is a sectional view of the FIG. 2 sole taken along the line 3—3.
Figure 5:
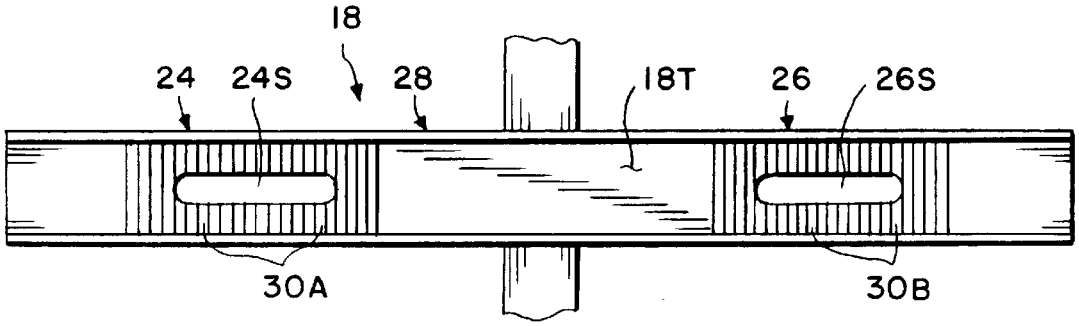
FIG. 5 is a top plan view of the FIG. 1 sole with the alignment posts removed.
Figure 6:
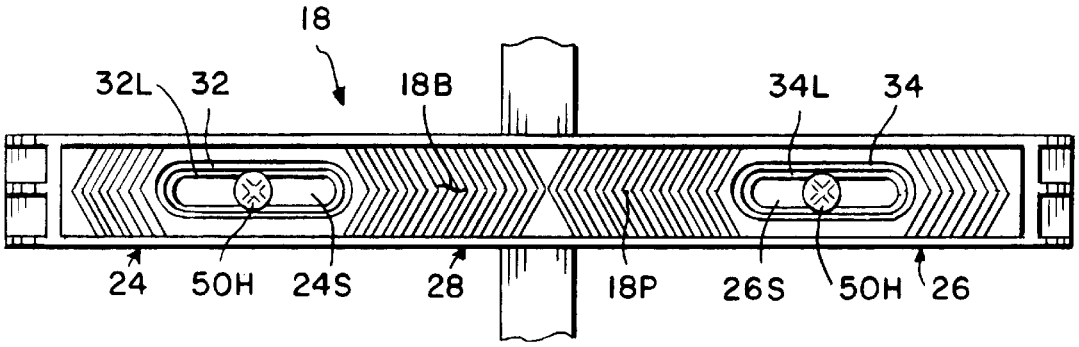
FIG. 6 is a bottom plan view of the FIG. 1 sole with each alignment post connected to the base by a bolt.

As shown in FIGS. 5 and 6, base 18 has first and second outer portions 24, 26 symmetrically disposed with respect to a central portion 28. Each base outer portion 24, 26 has therethrough a longitudinal slot 24S, 26S, respectively. As best shown in FIG. 5, on generally planar top surface 18T of base 18, slots 24S, 26S are bounded, respectively, by a plurality of transverse, evenly spaced corrugations 30A, 30B. As shown in FIGS. 3 and 6, slots 24S, 26S are circumscribed, respectively, by a terraced recess 32, 34 in base bottom surface 18B having an interior lip 32L, 34L, respectively. As shown in FIG. 6, surface 18B has a molded-in tread pattern 18P.

Figure 4A:
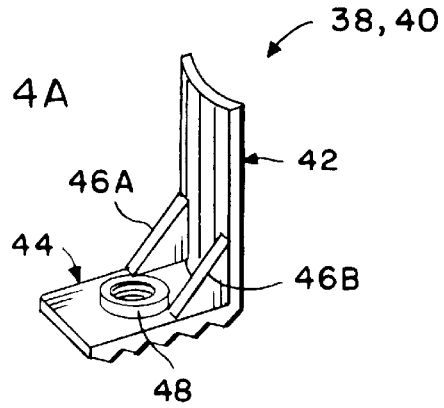
FIGS. 4A and 4B are perspective views of a FIG. 1 alignment post.
Figure 4B:
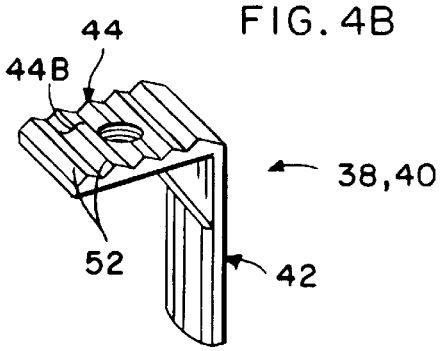

Referring to FIGS. 2, 3, 4A and 4B, the walking sole 10 further includes first and second alignment posts 38, 40 each having an arcuate portion 42 attached and generally orthogonal to a planar portion 44. As best shown in FIG. 4A, opposed ribs 46A, 46B reinforce the mechanical strength of attachment. The curvature of portion 42 is selected to conform to the thickness of a skate wheel so as to cup the wheel rim when brought into pressing contact. As shown in FIGS. 3 and 4A, post portion 44 has therethrough a threaded bushing 48 adapted to receive a standard bolt 50. As shown in FIG. 4B, post portion 44 has a bottom surface 44B with a plurality of corrugations 52 evenly spaced so as to interface with corrugations 30A, 30B when the posts are brought into slidable contact with base top surface 18T. As shown in FIGS. 3 and 6, posts 38, 40 are connected to the base 18 by tightening bolts 50 with a tool, preferably a Phillips-head screwdriver, until their heads 50H come into pressing contact with lips 32L and 34L.

Referring again to FIG. 1, the walking sole 10 further includes a fabric strap 60 having at one end a hook-tape surface 60H and at the other end a loop-tape surface 60L. Strap 60 is threaded through slots 22S and 24S. After the wheel lower portions are inserted into trough 20 and the alignment posts 38, 40 positioned and secured so as to come into pressing contact with the outer wheels, the skater puts the strap ends over the shoe toe portion and engages surface 60H with surface 60L in a relative position such that the strap is tight. To release the skate from the walking sole, it is necessary to disengage the hook-and-loop surfaces and loosen the bolts with the tightening tool. Some users may find it convenient to remove their skates before putting on or removing the walking soles.

What is claimed is:

1. A walking sole adapted to be worn over the wheels of an in-line roller skate including a shoe and an undercarriage to which the wheels are connected, comprising:

a U-shaped angle member having opposed first and second side walls and a base generally orthogonal to the side walls, the base having a generally planar top surface and a generally planar bottom surface, the base and side walls determining a longitudinal trough adapted to closely receive a lower portion of each wheel;

means for rigidly constraining fore and aft motion of the wheels when the wheel lower portions are inserted into the trough, said rigidly constraining means comprises first and second alignment posts each having a bottom surface in slidable contact with the base top surface; and locking means for rigidly fixing each post at a position where the post is in pressing contact against the rim of the wheel, said locking means for each post comprises a first plurality of transverse corrugations in the base top surface, and a second plurality of corrugations in the post bottom surface.

2. The walking sole of claim 1, wherein the bottom surface of the base as a tread pattern.

3. The walking sole of claim 2, wherein the U-shaped angle member is monolithically molded from a thermoplastic material.

4. The walking sole of claim 3, wherein the alignment posts are each monolithically molded from a thermoplastic material.

5. A walking sole adapted to be worn over the wheels of an in-line roller skate including a shoe and an undercarriage to which the wheels are connected, comprising:

a U-shaped angle member having opposed first and second side walls and a base generally orthogonal to the side walls, each side wall having opposed arcuate ends and a central portion having a generally horizontal slot disposed symmetrically between the two ends so that the slots are opposed, the base having a generally planar top surface and a generally planar bottom surface, the base having first and second outer portions symmetrically disposed with respect to a central portion, each base outer portion having a longitudinal slot therethrough, each slot bounded by a first plurality of transverse corrugations in the base top surface, each slot circumscribed by a recess in the base bottom surface terminating in a lip, the base and side walls determining a longitudinal trough adapted to closely receive a lower portion of each wheel; and first and second alignment posts each comprising a generally arcuate vertical portion shaped to conform to a wheel rim, the vertical portion attached and generally orthogonal to a horizontal portion having a bottom surface with a second plurality of transverse corrugations adapted to interface with said first plurality of corrugations, each horizontal portion having therethrough a bushing with a bore threaded to receive a bolt of a preselected size.

6. The walking sole of claim 5, further comprising a strap having at one end a hook-tape surface and at the other end a loop-tape surface, the strap inserted through the slot in each side wall.

7. The walking sole of claim 5, wherein the bottom surface of the base has a tread pattern.

8. The walking sole of claim 5, wherein the U-shaped angle member is monolithically molded from a thermoplastic material.

9. The walking sole of claim 5, wherein the alignment posts are each monolithically molded from a thermoplastic material.

* * * * *